US007900815B2

(12) United States Patent
Shmagin

(10) Patent No.: US 7,900,815 B2
(45) Date of Patent: Mar. 8, 2011

(54) ARTICLE CARRIER

(75) Inventor: Dmitriy L. Shmagin, Itasca, IL (US)

(73) Assignee: Stokely-Van Camp, Inc., Chicago, IL (US)

( * ) Notice: Subject to any disclaimer, the term of this patent is extended or adjusted under 35 U.S.C. 154(b) by 885 days.

(21) Appl. No.: 11/129,629

(22) Filed: May 13, 2005

(65) Prior Publication Data

US 2006/0255108 A1 Nov. 16, 2006

(51) Int. Cl.
*B65D 5/46* (2006.01)

(52) U.S. Cl. ..... 229/117.12; 229/103.2; 206/139; 206/161

(58) Field of Classification Search ..... 229/103.2, 229/117.12, 117.13; 206/139, 161, 143, 206/140, 141, 429, 435, 430, 434, 162
See application file for complete search history.

(56) References Cited

U.S. PATENT DOCUMENTS

| | | | | |
|---|---|---|---|---|
| 3,278,075 | A | 10/1966 | Weiss | |
| 3,353,709 | A | 11/1967 | Lawrence | |
| 3,398,856 | A | 8/1968 | Graser | |
| 3,424,368 | A | 1/1969 | Forrer | |
| 3,593,849 | A | 7/1971 | Helms et al. | |
| 3,679,121 | A | 7/1972 | Morgese | |
| 3,750,874 | A | 8/1973 | Detzel et al. | |
| 4,029,204 | A | 6/1977 | Manizza | |
| 4,029,207 | A | 6/1977 | Gordon | |
| 4,034,852 | A | 7/1977 | Forrer | |
| 4,215,781 | A | 8/1980 | Humphries et al. | |
| 4,341,309 | A | 7/1982 | Oliff | |
| 4,375,258 | A | 3/1983 | Crayne et al. | |
| 4,424,901 | A | 1/1984 | Lanier | |
| 4,637,515 | A | 1/1987 | Wilson et al. | |
| 4,681,217 | A | 7/1987 | Hernandez | |
| 4,747,534 | A | 5/1988 | Marie | |
| 4,784,266 | A * | 11/1988 | Chaussadas | 206/434 |
| 4,785,991 | A | 11/1988 | Schuster | |
| 4,901,849 | A | 2/1990 | Wilson | |
| 5,000,313 | A * | 3/1991 | Oliff | 206/140 |
| 5,060,792 | A | 10/1991 | Oliff | |
| 5,094,347 | A | 3/1992 | Schuster | |
| 5,131,588 | A | 7/1992 | Oliff | |
| 5,551,556 | A * | 9/1996 | Sutherland | 206/147 |
| 5,595,292 | A | 1/1997 | Bates | |
| 5,853,088 | A | 12/1998 | Saulas et al. | |
| 6,273,330 | B1 | 8/2001 | Oliff et al. | |

FOREIGN PATENT DOCUMENTS

| | | |
|---|---|---|
| DE | 3409890 A1 | 5/1985 |
| FR | 1361578 | 5/1964 |
| FR | 1564751 | 4/1969 |

OTHER PUBLICATIONS

European Search Report dated Sep. 6, 2006.

* cited by examiner

*Primary Examiner* — Nathan J Newhouse
*Assistant Examiner* — Christopher Demeree
(74) *Attorney, Agent, or Firm* — Banner & Witcoff, Ltd.

(57) ABSTRACT

The present invention relates a carrier comprising: (a) a bottom wall; (b) two sidewalls; and (c) a top wall having a first edge that forms an edge of at least one collapsible tab when the tab is uncollapsed and a second edge that forms an edge of at least one other collapsible tab when the tab is uncollapsed, wherein the collapsible tabs are adapted to collapse downward and fold inward and out of the plane of the top wall. The carrier of the present invention provides a grasping and handling feature which eliminates the formation of concentrated stress areas while providing a comfortable grip for the consumer.

30 Claims, 4 Drawing Sheets

ARTICLE CARRIER

FIELD OF THE INVENTION

The invention generally relates to a carrier for bottles, cans or the like, more specifically, to a multi-pack wrap-around carrier having a gripping feature. The gripping feature of the subject invention eliminates the formation of stress concentration areas, creates carrier handling strength and provides a comfortable grip feature for the consumer.

BACKGROUND OF THE INVENTION

Groups of articles, such as bottles and cans, are commonly packaged and sold in multi-pack carriers. Typically, the carrier is formed from a blank of paperboard or similar foldable sheet material, which is then wrapped around the group of articles. The carton generally comprises two sidewalls foldably connected to a top wall and a bottom wall. The ends of the carton are left open. To stabilize the articles within the carton, the sidewalls can contain openings adjacent the top wall for receiving a portion of the tops of the articles and openings adjacent the bottom wall for receiving a portion of the base of the articles.

A common concern with existing multi-pack carriers is the need to create a comfortable grip that will also eliminate the formation of stress concentration areas which cause a carton to tear under the weight of the articles. Such cartons may contain finger holes in the top panel for lifting and carrying the carton by the thumb and a finger. One problem associated with carrying the carton in this fashion is the tendency of the carton to tear at or near the finger holes due to the concentration of stress. Alternatively, such cartons may lack finger holes, in which case the carton is picked-up and carried by the flat edges of the top wall of the carton. There are at least two problems with carrying the carton in this fashion. The first problem is the tendency of the corners of the carton to tear due to formation of stress concentration areas at or near the corners of the carton. The second problem is that carrying the carton by the flat edges of the top wall is awkward and uncomfortable.

Accordingly, there is a need for a carrier with a grasping and handling feature which eliminates the formation of concentrated stress areas while providing a comfortable grip for the consumer.

SUMMARY OF INVENTION

The present invention relates to a carrier comprising: (a) a bottom wall; (b) two sidewalls; and (c) a top wall having a first edge that forms an edge of at least one collapsible tab when the tab is uncollapsed and a second edge that forms an edge of at least one other collapsible tab when the tab is uncollapsed, wherein the collapsible tabs are adapted to collapse downward and fold inward and out of the plane of the top wall.

The present invention also relates to a method for grasping a carrier comprising providing a carrier comprising: (a) a bottom wall; (b) two sidewalls; and (c) a top wall having a first edge that forms an edge of at least one collapsible tab when the tab is uncollapsed and a second edge that forms an edge of at least one other collapsible tab when the tab is uncollapsed, wherein the collapsible tabs are adapted to collapse downward and fold inward and out of the plane of the top wall; and collapsing the tabs by applying pressure to the tabs.

Other aspects, objects and advantages of the present invention will be understood from the following description according to the preferred embodiments of the present invention, specifically including stated and unstated combinations of the various features which are described herein, relevant information concerning which is shown in the accompanying drawings.

BRIEF DESCRIPTION OF THE DRAWINGS

In the course of this description, reference will be made to the accompanying drawings, wherein.

DESCRIPTION OF THE PREFERRED EMBODIMENTS

For simplification in describing the current invention, the articles contained in the carrier will generally be described as bottles 12.

Figure 1:
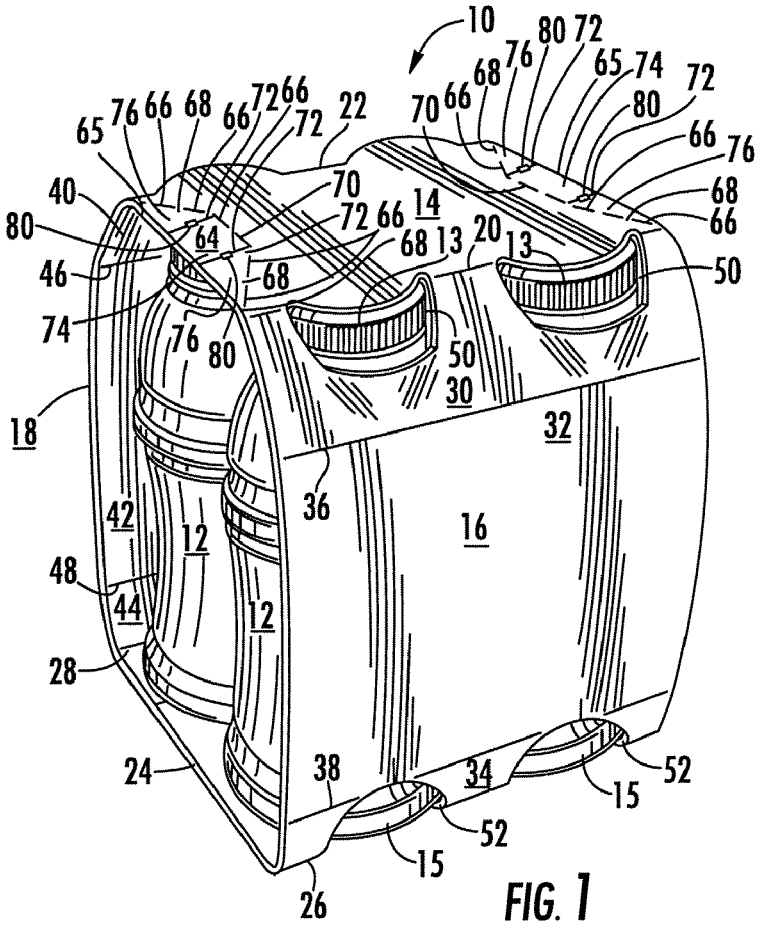
FIG. 1 is a perspective view of a preferred embodiment of a carrier of the present invention, shown containing four filled bottles, the carrier being in a shelf display state.

Referring to FIG. 1, carrier 10 comprises top wall 14, sidewalls 16 and 18, and bottom wall 24. Carrier 10 can be any packaging material deemed appropriate for the packaging challenge at hand. Examples of materials useful in the present invention include paper, corrugated paper and fiber board. Corrugated paper is preferably used. Preferably, carrier 10 has a first open end and a second open end. Carrier 10 is preferably wrapped around at least a portion of bottles 12.

Sidewalls 16 and 18 may be foldably connected to top wall 14 by fold lines 20 and 22. Sidewalls 16 and 18 may also be foldably connected to bottom wall 24 by fold lines 26 and 28.

Figure 3:
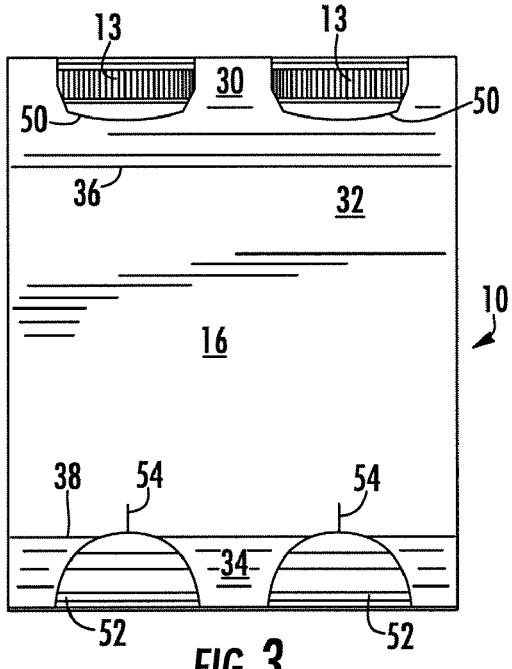
FIG. 3 is a front elevation plan view of the carrier illustrated in FIG. 1.

As illustrated in FIG. 3, sidewall 16 may be divided into upper sidewall 30 by score line 36. Sidewall 16 can be divided into main sidewall 32 by score lines 36 or 38. Additionally, sidewall 16 can be divided into lower sidewall 34 by score line 38. Sidewall 18 may be divided into upper sidewall 40 by score line 46. Sidewall 18 may be divided into main sidewall 42 by score lines 46 or 48. Additionally, sidewall 18 can be divided into lower sidewall 44 by score line 48. Score lines 36, 38, 46 and 48 can be formed by any method known in the art.

Figure 2:
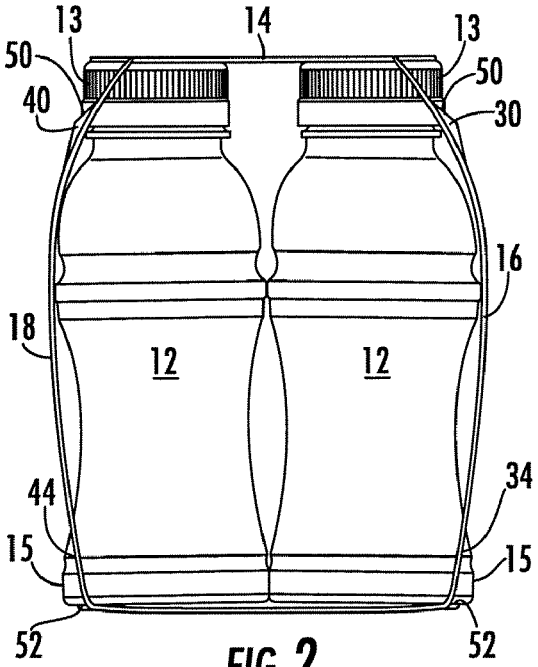
FIG. 2 is an end elevation plan view of the carrier illustrated in FIG. 1.
Figure 4:
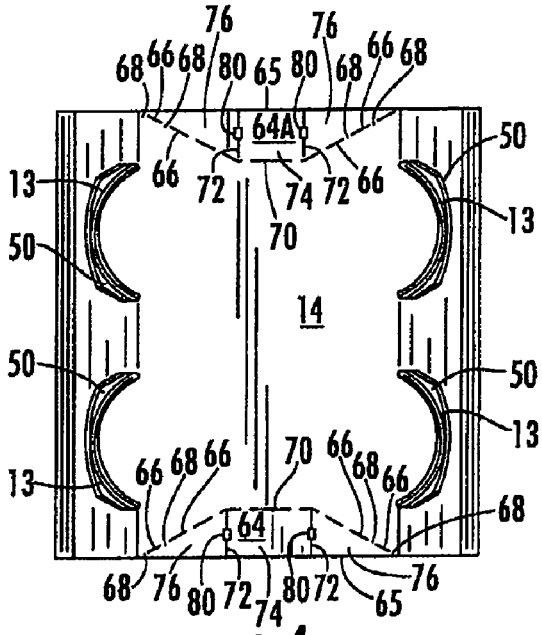
FIG. 4 is a top plan view of the carrier illustrated in FIG. 1.
Figure 8:
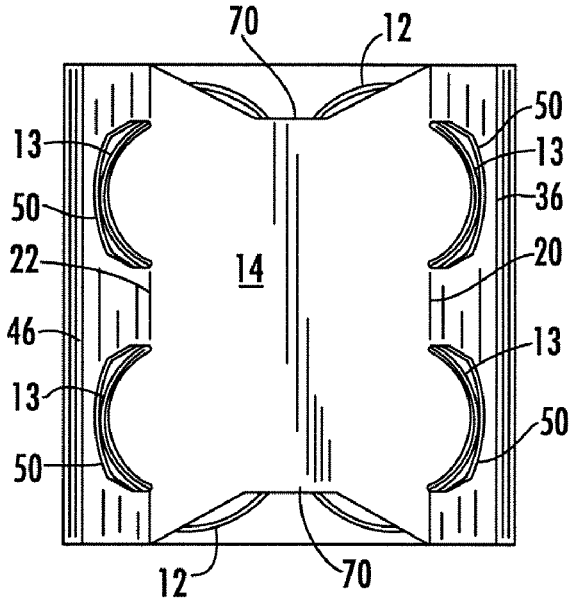
FIG. 8 is a top plan view of the carrier shown in FIG. 1 after the tabs have been collapsed.

Referring to FIGS. 1-3, upper sidewalls 30 and 40 may also include openings 50 located adjacent top wall 14. Openings 50 can be any shape but preferably are in the shape of a semi-circle. Openings 50 may take on the form of a truncated crescent when viewed from above, such as is shown in FIGS. 4 and 8.

Referring to FIG. 2, closures 13 on the bottles 12 may protrude through openings 50. Additionally, lower sidewalls 34 and 44 may include one or more openings 52 substantially adjacent bottom wall 24. Openings 52 can be any shape but preferably are in the shape of a semi-circle. Openings 52 may take on the form, when viewed from below as in FIG. 5, of truncated crescents.

Referring again to FIG. 2, base 15 of each bottle 12 may protrude through each respective opening 52. Main sidewalls 32 and 42 may contain one or more slit(s) 54. "Slits" generally refers to a cut or otherwise open portion of carrier 10. Slits 54 preferably extend transversely of score lines 38 and 48. Additionally, slits 54 preferably bisect at least one opening 52. Slits 54 allow for variation in the size of the bottles 12 to be packaged and/or accommodate bottles with outwardly tapering bottom sidewalls of the type illustrated in the drawings. The purpose of this arrangement is to stabilize the bottles 12 and hold them in place. Slits 54 can be formed in the carrier by any method known in the art.

Figure 5:
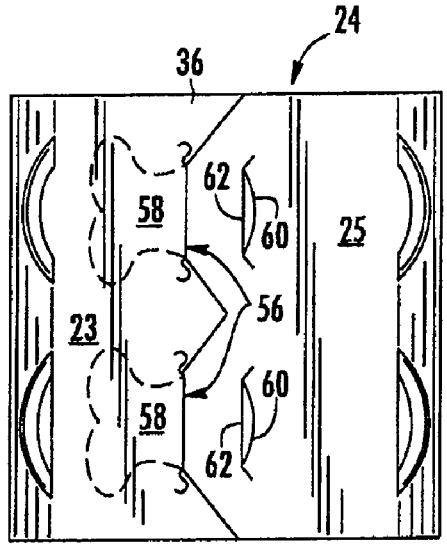
FIG. 5 is a bottom plan view of the carrier illustrated in FIG. 1.
Figure 9:
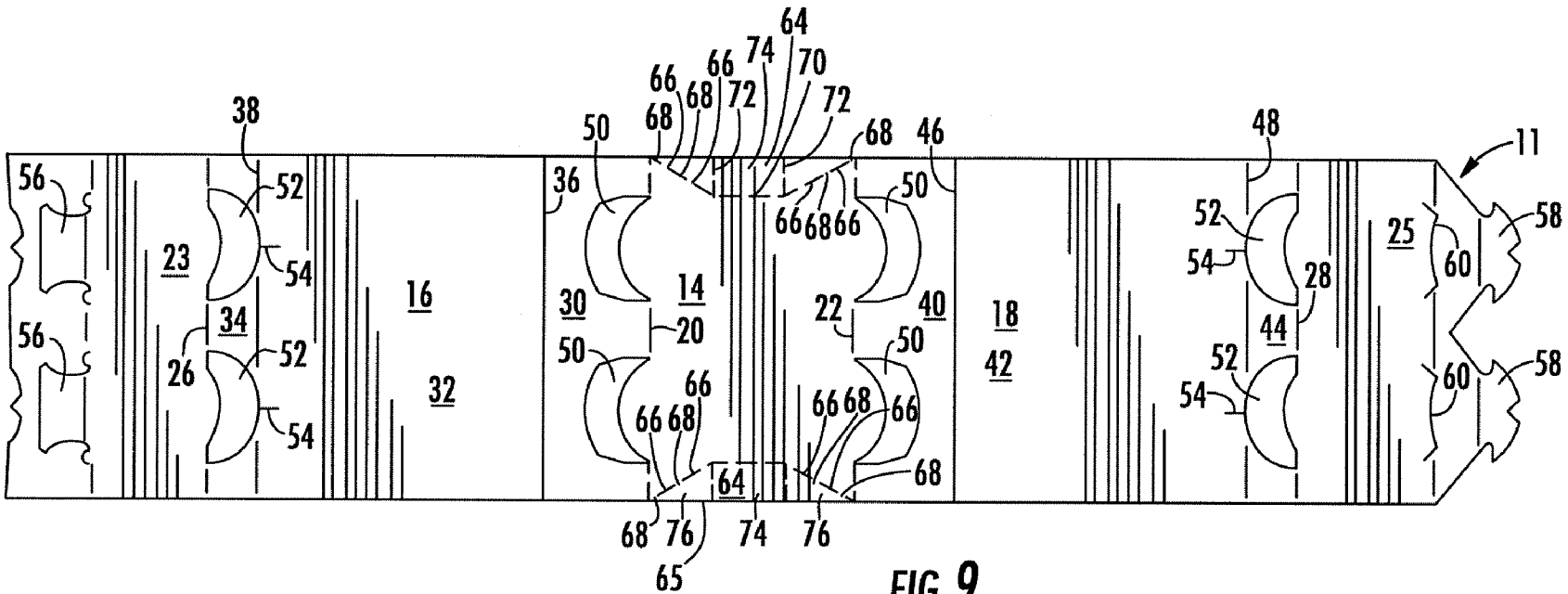
FIG. 9 is a top planar view of the carrier shown in FIG. 1 prior to folding.

As shown in FIG. 5, bottom wall 24 of carrier 10 can be formed by connecting bottom wall sections 23 and 25. For example, bottom wall 24 can be formed by Mechanically locking and counter-locking together sections 23 and 25. Bottom wall section 23 can include apertures 56 which receive and mechanically interlock with tabs 58 (shown in FIG. 9) protruding from bottom wall section 25. Slits 60 located in section 25 then receive a portion 62 of section 23 to form a counter-lock which prevents tabs 58 from disengaging apertures 56. It should be understood that, although the mechanical interlocking mechanism described sufficiently connects the sections to form the bottom panel, any arrangement for suitably forming the bottom wall could be used.

Referring to FIGS. 1 and 4, top wall 14 comprises at least two collapsible tabs 64 and 64A. "Collapsible" tabs refer to a portion or portions of carrier 10 capable of collapsing or folding under stress. Stress that is applied can be in the form of force, weight or pressure. Collapsible tab 64 is formed from a first edge 65 of top wall 14. Preferably, collapsible tab 64 is located at an edge of top wall 14 substantially adjacent a first open end of carrier 14. Collapsible tab 64 preferably extends inwardly from a first edge 65 of top wall 14. Collapsible tab 64 is adapted to collapse downward and fold inward and out of the plane of top wall 14.

Collapsible tab 64A is formed from a second edge 65 of top wall 14. Preferably, collapsible tab 64A is located at an edge of top wall 14 substantially adjacent a second open end of carrier 14. Collapsible tab 64A preferably extends inwardly from a second edge 65 of top wall 14. Collapsible tab 64A is adapted to collapse downward and fold inward and out of the plane of top wall 14.

Preferably, collapsible tabs 64 and 64A include at least two non-adjacent portions adapted to collapse downward and fold inward and out of the plane of top wall 14, wherein the non-adjacent portions have at least one perforation each. More preferably, collapsible tabs 64 and 64A are formed by providing at least two non-adjacent or adjacent portions adapted to collapse downward and fold inward and out of the plane of top wall 14, wherein the non-adjacent or adjacent portions have at least two perforations each such that the perforations are spaced from one another with uncut or otherwise intact portions of top wall 14. Most preferably, collapsible tabs 64 and 64A are formed by providing at least three adjacent portions adapted to collapse downward and fold inward and out of the plane of top wall 14, wherein the adjacent portions have at least two perforations each such that the perforations are spaced from one another with uncut or otherwise intact portions of top wall 14. "Perforation" generally refers to a cut or otherwise open portion of carrier 10. Perforations are formed on carrier 10 by any method known in the art. Uncut segments or otherwise intact portions of top wall 14 readily brake down or tear when stress is applied.

Collapsible tabs 64 and 64A have an initial or uncollapsed configuration in which the tab is substantially unsevered from the surrounding portions of top wall 14. Preferably, collapsible tabs 64 and 64A are co-planar with the surrounding portions of top wall 14. Collapsible tabs 64 and 64A can be any size or shape. Preferably, collapsible tabs 64 and 64A comprise a generally trapezoidal shape.

To provide flexibility in collapsible tabs 64 and 64A, the tabs may contain a pair of fold lines 72 extending transversely and outwardly from fold line 70 to the base of the tab. Fold lines 72 can divide preferred trapezoidal shaped collapsible tabs 64 and 64A into three sections, including a rectangularly shaped section 74 located between two triangularly shaped sections, each generally designated 76. Each fold line 72 may also contain a small perforation 80 located in the center of the fold line and extending in the same direction as the fold line. As described in more detail below, it may be desirable for the carrier to include flexible tabs in order to prevent the tops of the bottles from interfering with the collapsing and folding of the tabs.

Figure 6:
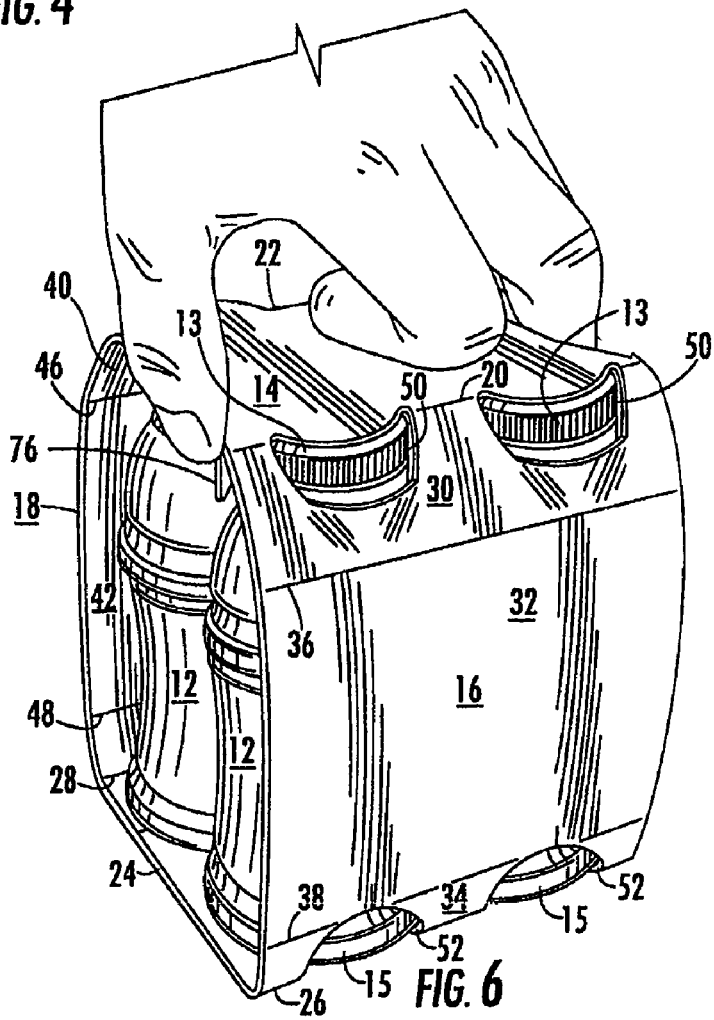
FIG. 6 is a perspective view of the carrier illustrated in FIG. 1 being grasped by a thumb and finger.
Figure 7:
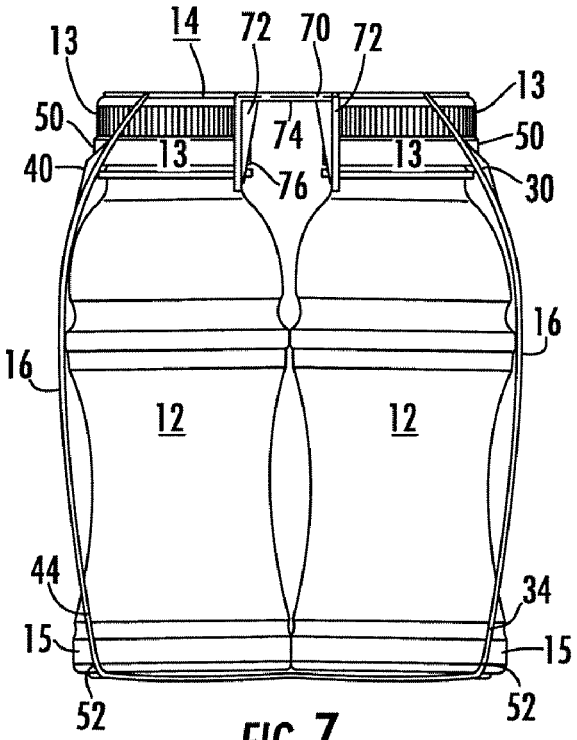
FIG. 7 is an end elevation plan view of FIG. 1 after the tabs have been collapsed.

In operation, as illustrated in FIGS. 6-8, a consumer grasps carrier 10 and preferably applies downward stress on collapsible tabs 64 and 64A. Preferably, the thumb and at least one finger are used to apply the stress. In one embodiment, the stress tears the uncut or frangible paperboard segment 68 and collapses collapsible tabs 64 and 64A out of the plane of the top wall. As illustrated in FIG. 7, in one embodiment of the present invention, triangular sections 76 of tab 64 come in contact with bottle tops 13 forcing the tabs to fold along fold lines 72. The rectangular section 74 of collapsible tabs 64 and 64A passes between the tops of the bottles 13 and the tab continues to fold inwardly until the rectangular section 74 is bent back up against the underside of top wall 14. In this embodiment, a double layer of paperboard forms about fold line 70 which both strengthens carrier 10 at the location of collapsed tabs 64 and 64A, thereby creating a comfortable gripping surface for the consumer.

Referring to FIG. 6, the consumer may grasp and carry away carrier 10 by placing a thumb and at least one finger at the locations where collapsed tabs 64 and 64A fold. The methods set forth in this invention eliminate stress concentration areas by diverting stress away from the corners of carrier 10 and redirecting the stress towards the center of the top wall and towards the sidewalls of carrier 10.

It will be understood that the embodiments of the present invention which have been described are illustrative of some of the applications of the principles of the present invention. Numerous modifications may be made by those skilled in the art without departing from the true spirit and scope of the invention, including those combinations of features that are individually disclosed or claimed herein.

I claim:

1. A carrier comprising:

(a) a bottom wall;

(b) a first sidewall and an opposing second sidewall; and (c) a planar top wall having a first edge at an outer-periphery of the top wall that forms an edge of a first collapsible tab when the first tab is uncollapsed, a second edge at the outer-periphery of the top wall that forms an edge of a second collapsible tab when the second tab is uncollapsed, a third edge connected only to the first sidewall and a fourth edge connected only to the second sidewall;

wherein the collapsible tabs are adapted to collapse downward and fold inward and out of the plane of the top wall, wherein the first collapsible tab extends inwardly from the first edge of the top wall, and the second collapsible tab extends inwardly from the second edge of the top wall, and wherein the top wall is configured to provide an indented gripping surface at a point of connection between the first collapsible tab and the top wall and between the second collapsible tab and the top wall when the first collapsible tab and the second collapsible tab are collapsed, and wherein at least a portion of each of the collapsible tabs is configured to abut a bottom surface of the top wall when collapsed and when the carrier contains articles.

2. The carrier of claim 1 wherein the first edge of the top wall is substantially adjacent a first open end of the carrier.

3. The carrier of claim 1 wherein the second edge of the top wall is substantially adjacent a second open end of the carrier.

4. The carrier of claim 1 wherein a score line foldably connects at least one sidewall to the top wall.

5. The carrier of claim 1 wherein a score line foldably connects at least one sidewall to the bottom wall.

6. The carrier of claim 1 wherein score lines foldably connect at least one sidewall to the top and bottom walls.

7. The carrier of claim 1 wherein the first collapsible tab and the second collapsible tab are hingedly connected to the top wall.

8. The carrier of claim 1 wherein each of the first collapsible tab and the second collapsible tab comprise a generally trapezoidal shape.

9. The carrier of claim 1 wherein each of the first collapsible tab and the second collapsible tab comprise two portions not in direct contact with each other having one perforation each.

10. The carrier of claim 1 wherein each of the first collapsible tab and the second collapsible tab comprise at least two portions having at least two perforations wherein the perforations are spaced from one another with uncut or otherwise intact portions.

11. The carrier of claim 1 wherein a slit extends transversely of a score line that connects the sidewall to the bottom wall.

12. The carrier of claim 11 wherein at least one slit bisects an opening.

13. The carrier of claim 1 wherein at least one sidewall comprises at least one opening adapted to receive at least a portion of at least one article.

14. The carrier of claim 1, wherein the first sidewall and the second sidewall further comprise a first upper sidewall and a second upper sidewall, wherein the first upper sidewall and the second upper sidewall form an upper portion of the first sidewall and the second sidewall, and wherein the first upper sidewall and the second upper sidewall connect to the top wall on a plane transverse to a plane of the top wall.

15. A method for grasping a carrier comprising:

providing a carrier comprising:

(a) a bottom wall;

(b) a first sidewall and an opposing second sidewall; and (c) a planar top wall having a first edge at an outer-periphery of the top wall that forms an edge of a first collapsible tab when the first collapsible tab is uncollapsed, a second edge at the outer-periphery of the top wall that forms an edge of a second collapsible tab when the second collapsible tab is uncollapsed, a third edge connected only to the first sidewall and a fourth edge connected only to the second sidewall, wherein the first collapsible tab inwardly from the first edge of the top wall, and the second collapsible tab extends inwardly from the second edge of the top wall;

wherein the first collapsible tab and second collapsible tab are adapted to collapse downward and fold inward and out of the plane of the top wall, and wherein the top wall is configured to provide an indented gripping surface at a point of connection between the first collapsible tab and the top wall and between the second collapsible tab and the top wall when the first collapsible tab and the second collapsible tab are collapsed; and collapsing the first collapsible tab and the second collapsible tab by applying pressure to the first collapsible tab and the second collapsible tab where at least a portion of each of the collapsible tabs abut a bottom surface of the top wall when collapsed and when the carrier contains articles.

16. The method according to claim 15 wherein the first edge of the top wall is substantially adjacent a first open end of the carrier.

17. The method according to claim 15 wherein the second edge of the top wall is substantially adjacent a second open end of the carrier.

18. The method according to claim 15 wherein a score line foldably connects at least one sidewall to the top wall.

19. The method according to claim 15 wherein a score line foldably connects at least one sidewall to the bottom wall.

20. The method according to claim 15 wherein score lines foldably connect at least one sidewall to the top and bottom walls.

21. The method according to claim 15 wherein the first collapsible tab and the second collapsible tab are hingedly connected to the top wall.

22. The method according to claim 15 wherein each of the first collapsible tab and the second collapsible tab comprise a generally trapezoidal shape.

23. The method according to claim 15 wherein each of the first collapsible tab and the second collapsible tab comprise two portions not in direct contact with each other having one perforation each.

24. The method according to claim 15 wherein each of the first collapsible tab and the second collapsible tab comprise at least two adjacent portions or portions not in direct contact with each other having at least two perforations each wherein the perforations are spaced from one another with uncut or otherwise intact portions.

25. The method according to claim 15 wherein a slit extends transversely of a score line that connects the sidewall to the bottom wall.

26. The method according to claim 25 wherein at least one slit bisects an opening.

27. The method according to claim 15 wherein at least one sidewall comprises at least one opening adapted to receive at least a portion of at least one article.

28. The method according to claim 15, wherein the first sidewall and the second sidewall further comprise a first upper sidewall and a second upper sidewall, wherein the first upper sidewall and the second upper sidewall form an upper portion of the first sidewall and the second sidewall, and wherein the first upper sidewall and the second upper sidewall connect to the top wall on a plane transverse to a plane of the top wall.

29. A carrier comprising:

(a) a bottom wall;

(b) a first sidewall and an opposing second side wall; and (c) a planar top wall having a first edge at an outer-periphery of the top wall that forms an edge of a first collapsible tab when the first collapsible tab is uncollapsed, a second edge at the outer-periphery of the top wall that forms an edge of a second collapsible tab when the second collapsible tab is uncollapsed, a third edge connected only to the first sidewall and a fourth edge connected only to the second sidewall, wherein the first collapsible tab extends inwardly from the first edge of the top wall, and the second collapsible tab extends inwardly from the second edge of the top wall;

wherein the first collapsible tab and the second collapsible tab are adapted to collapse downward and fold inward and out of the plane of the top wall, and wherein at least a portion of each of the collapsible tabs is configured to abut a bottom surface of the top wall when collapsed and when the carrier contains articles.

30. The carrier of claim 29, wherein the first sidewall and the second sidewall further comprise a first upper sidewall and a second upper sidewall, wherein the first upper sidewall and the second upper sidewall form an upper portion of the first sidewall and the second sidewall, and wherein the first upper sidewall and the second upper sidewall connect to the top wall on a plane transverse to a plane of the top wall.

* * * * *